US008707942B2

(12) United States Patent
Lu

(10) Patent No.: US 8,707,942 B2
(45) Date of Patent: Apr. 29, 2014

(54) ROTARY WHEEL FOR BALL PITCHING MACHINE

(76) Inventor: Sheng-Hsiao Lu, Tainan (TW)

( * ) Notice: Subject to any disclaimer, the term of this patent is extended or adjusted under 35 U.S.C. 154(b) by 138 days.

(21) Appl. No.: 13/481,931

(22) Filed: May 28, 2012

(65) Prior Publication Data

US 2013/0312723 A1 Nov. 28, 2013

(51) Int. Cl.

*A63B 69/40* (2006.01)
*F41B 4/00* (2006.01)
*A63B 69/00* (2006.01)

(52) U.S. Cl.

CPC ..... *A63B 69/406* (2013.01); *A63B 2069/401* (2013.01); *F41B 4/00* (2013.01); *A63B 2069/0008* (2013.01)

USPC ..... 124/78; 124/1; 124/6; 124/80; 124/81; 473/436; 473/451

(58) Field of Classification Search

CPC ..... A63B 69/406; A63B 2069/401; A63B 2069/0008; F41B 4/00

USPC ..... 124/1, 6, 78, 80, 81; 473/436, 451

See application file for complete search history.

(56) References Cited

U.S. PATENT DOCUMENTS 1,204,468 A * 11/1916 Marty ..... 124/6
2,716,973 A * 9/1955 Desi ..... 124/78
3,306,613 A * 2/1967 Mainers ..... 473/436
3,459,168 A * 8/1969 Bruce ..... 124/78
3,538,900 A * 11/1970 Samuels ..... 124/78
3,604,409 A * 9/1971 Doeg ..... 124/78
3,724,437 A * 4/1973 Halstead ..... 124/78
3,785,358 A * 1/1974 D'Angelo et al. ..... 124/78
3,815,567 A * 6/1974 Serra ..... 124/78
3,913,552 A * 10/1975 Yarur et al. ..... 124/78
4,026,261 A * 5/1977 Paulson et al. ..... 124/78
4,080,950 A * 3/1978 Paulson et al. ..... 124/1
4,153,303 A * 5/1979 Tanner ..... 301/64.706
4,197,827 A * 4/1980 Smith ..... 124/78
4,256,304 A * 3/1981 Smith et al. ..... 473/451
RE30,703 E * 8/1981 Paulson et al. ..... 124/1
4,323,047 A * 4/1982 McIntosh et al. ..... 124/1
4,372,284 A * 2/1983 Shannon et al. ..... 124/78
4,442,823 A * 4/1984 Floyd et al. ..... 124/78
4,561,414 A * 12/1985 Nozato ..... 124/78
4,632,088 A * 12/1986 Bruce ..... 124/78
4,655,190 A * 4/1987 Harris ..... 124/78
4,712,534 A * 12/1987 Nozato ..... 124/78
4,922,885 A * 5/1990 Iwabuchi et al. ..... 124/78

(Continued)

*Primary Examiner* — Gene Kim
*Assistant Examiner* — Alexander Niconovich
(74) *Attorney, Agent, or Firm* — Alan Kamrath; Kamrath IP Lawfirm, P.A.

(57) ABSTRACT

A rotary wheel for a ball pitching machine includes a wheel body and a resilient member engaged on an outer periphery of the wheel body. A shaft hole is provided in the wheel body for receiving a shaft of a motor of the ball pitching machine. The wheel body includes a spring portion arranged between the shaft hole and the outer periphery of the wheel body in a radial direction and including first and second bending portions both of which protrude from two sides of the wheel body respectively. When the rotary wheel is driven to turn by the motor, a frictional force of contact of the resilient member with a ball makes the ball shot outwardly, and the rotary wheel is not broken or damaged due to the spring portion compressed in the radial direction to absorb the impact energy.

7 Claims, 6 Drawing Sheets

(56) References Cited

U.S. PATENT DOCUMENTS

| | | | | |
|---|---|---|---|---|
| 5,044,350 | A * | 9/1991 | Iwabuchi et al. | 124/51.1 |
| 5,127,390 | A * | 7/1992 | Paulson | 124/80 |
| 5,437,261 | A * | 8/1995 | Paulson et al. | 124/78 |
| 5,464,208 | A * | 11/1995 | Pierce | 473/451 |
| 5,826,568 | A * | 10/1998 | Van Ross, Jr. | 124/6 |
| 5,832,909 | A * | 11/1998 | Grant et al. | 124/6 |
| 6,082,350 | A * | 7/2000 | Crews et al. | 124/78 |
| 6,093,117 | A * | 7/2000 | Sherlock et al. | 473/422 |
| 6,401,704 | B1 * | 6/2002 | Caldwell | 124/78 |
| 6,402,640 | B1 * | 6/2002 | Stuart | 473/422 |
| 6,427,675 | B1 * | 8/2002 | Caldwell et al. | 124/78 |
| 6,672,297 | B1 * | 1/2004 | Liao | 124/6 |
| 6,732,724 | B1 * | 5/2004 | Paulson et al. | 124/6 |
| 7,011,084 | B2 * | 3/2006 | Richard | 124/78 |
| 7,383,832 | B2 * | 6/2008 | Soberg | 124/6 |
| 7,448,370 | B2 * | 11/2008 | Lu | 124/6 |
| 7,900,618 | B1 * | 3/2011 | Angermeier | 124/6 |
| 8,133,137 | B2 * | 3/2012 | Grant et al. | 473/451 |
| 2006/0135290 | A1 * | 6/2006 | Lin | 473/451 |
| 2012/0312290 | A1 * | 12/2012 | Paulson | 124/78 |

* cited by examiner

ROTARY WHEEL FOR BALL PITCHING MACHINE

BACKGROUND OF THE INVENTION

1. Field of the Invention

The present invention relates to a rotary wheel for a ball pitching machine and, more particularly, to a rotary wheel structure used in a baseball or softball pitching machine.

2. Description of the Related Art

A general ball pitching machine includes one or two rotary wheels driven by a motor and provides batting practice or defense practice by shooting baseballs or softballs.

FIGS. 1 and 2 illustrate a conventional rotary wheel 10 for a ball pitching machine. The rotary wheel 10 includes a circular wheel body 12, a resilient member 14 fitted around an outer periphery of the wheel body 12, and a sleeve 16 engaged to a center of the wheel body 12. The wheel body 12, the resilient member 14, and the sleeve 16 are unified into a one-piece construction. Manufactured with resilient material such as urethane in general, the resilient member 14 contacts a ball during rotation of the rotary wheel 10 to create a frictional force and pitch the ball. The sleeve 16 is generally manufactured with a metal material and has a central shaft hole 18 to be penetrated by and coupled with a shaft of a motor (not shown), so that the rotary wheel 10 can be driven by the motor. In a course of pitching one ball, the resilient member 14, however, is compressed to make the plastic wheel body 12 suffer from compression-induced shocks, such that the wheel body 12 is easily broken or damaged as well as the sleeve 16 may be easily separated from the wheel body 12. Finally, the conventional rotary wheel 10 will not be driven to turn by the motor when the sleeve 16 is separated from the wheel body 12.

BRIEF SUMMARY OF THE INVENTION

Thus, an objective of the present invention is to provide a rotary wheel for a ball pitching machine to improve the aforementioned problems. The rotary wheel of the present invention includes a spring design to resist shocks, so that the rotary wheel is not easily broken or damaged in use and has the advantages of long service life.

To achieve this and other objectives, a rotary wheel of the present invention includes a wheel body and a resilient member which is integrally engaged on an outer periphery of the wheel body. The wheel body includes first and second surfaces opposite along an axis and a shaft hole provided in the wheel body and adapted to be extended through by a shaft of a motor of a ball pitching machine. The rotary wheel further includes an annular spring portion formed between the shaft hole and the outer periphery of the wheel body in a radial direction perpendicular to the axis. The spring portion includes a first bending portion protruding outwardly from the first surface and a second bending portion protruding outwardly from the second surface of the wheel body, such that each of the first and second bending portions can be compressed or stretched in the radial direction.

In a preferred form, the spring portion includes a first annular wall extending outwardly from the first surface, a second annular wall extending outwardly from the second surface, and a third annular wall interconnected between outer ends of the first and second annular walls, defining the first and second bending portions. Each of the first and second annular walls is extended at an obtuse angle relative to the radial direction of the wheel body, and each of the first and second bending portions has V-shaped cross sections. The spring portion further includes a plurality of cutting slots provided in each of the first and second bending portions and spaced in a peripheral direction of the spring portion for adjusting resilience of the spring portion.

Preferably, the rotary wheel further includes spaced inner and outer convex ribs formed on at least one of the first and second surfaces and around the shaft hole of the wheel body. Two opposite engaging slots are provided in each of the inner and outer convex ribs of the wheel body and aligned in the radial direction, defining a coupling socket for a pin rod inserted and coupled. The pin rod extends through a connecting hole formed in the shaft of the motor.

The present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

DETAILED DESCRIPTION OF THE INVENTION

Figure 6:
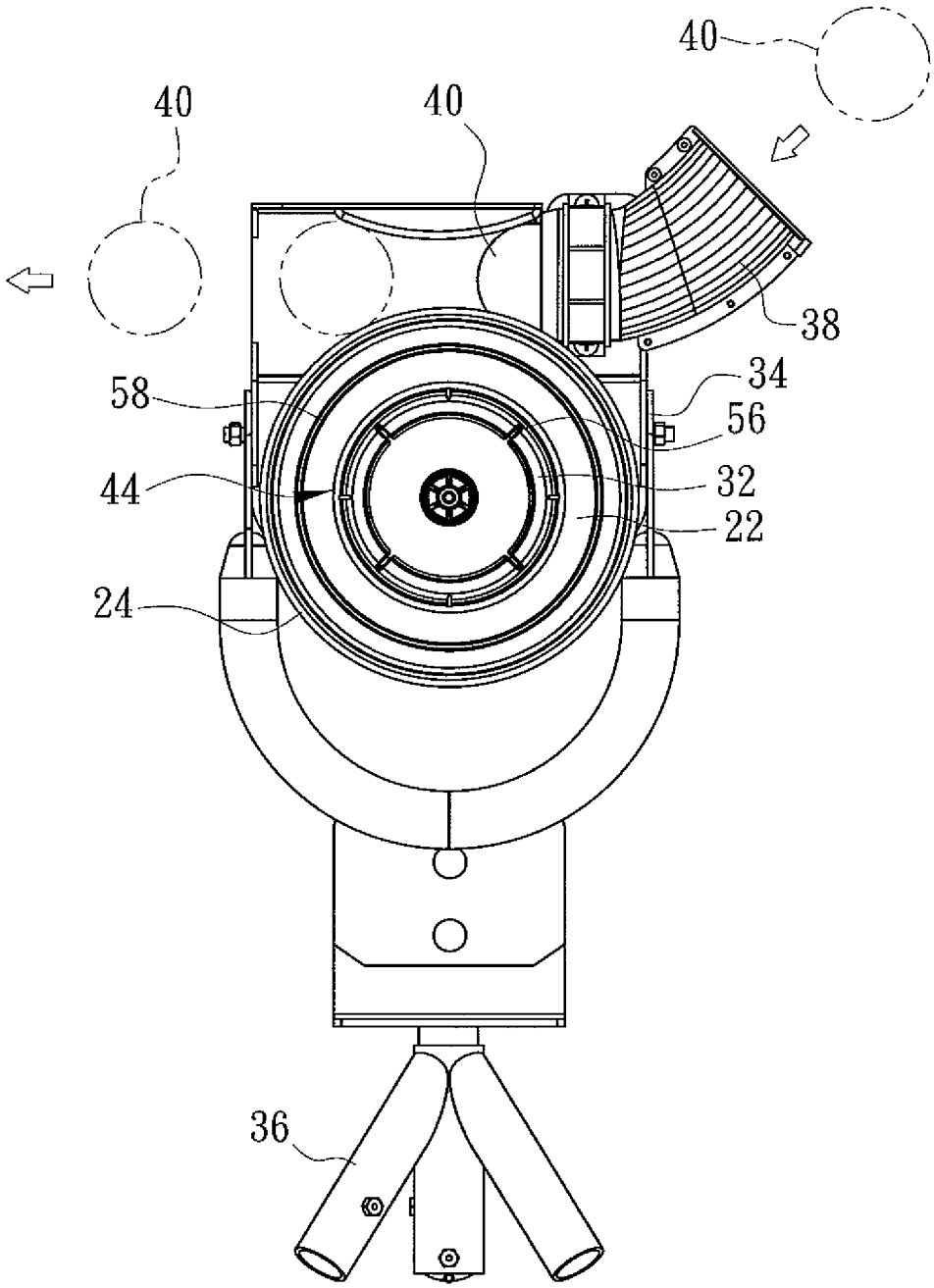
FIG. 6 shows a schematic illustration for one ball fed into the machine housing via a ball inlet tube in FIG. 5 and shot by the rotary wheel of the present invention.

A rotary wheel of an embodiment of the present invention is shown in FIGS. 3 through 6 of the drawings and generally designated 20. The rotary wheel 20 includes a circular wheel body 22 and an annular resilient member 24. The wheel body 22 is manufactured with a plastic material and includes first and second surfaces 25 and 26 opposite along an axis. A shaft hole 28 is provided in a center of the wheel body 22 and extends from the first surface 25 through the second surface 26 along the axis. A shaft 32 of a motor 30 of a ball pitching machine extends through the shaft hole 28, so that the rotary wheel 20 can be driven to turn by the motor 30. The motor 30 is mounted on a machine housing 34 of the ball pitching machine, and the rotary wheel 20 is installed in the machine housing 34. The machine housing 34 joins both a foot stand 36 at a bottom thereof and a cover (not shown). Furthermore, a ball inlet tube 38 is mounted at a top of the machine housing 34 and used to feed a ball 40 such as a baseball or softball into the machine housing 34. The resilient member 24 is manufactured with resilient material and unified onto an outer periphery 42 of the wheel body 22. When the rotary wheel 20 is driven to turn by the motor 30, a frictional force of contact of the resilient member 24 with the ball 40 makes the ball 40, which has been fed into the machine housing 34, shot outwardly (FIG. 6).

Figure 1:
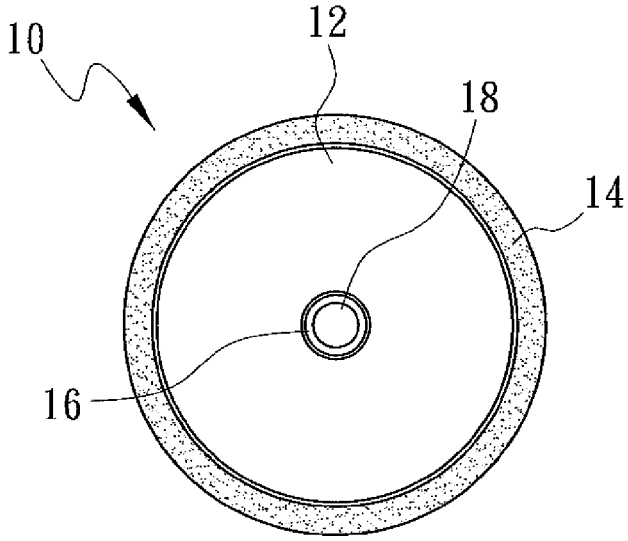
FIG. 1 Prior Art
FIG. 1 is a schematic illustration of a conventional rotary wheel for a ball pitching machine.
Figure 2:
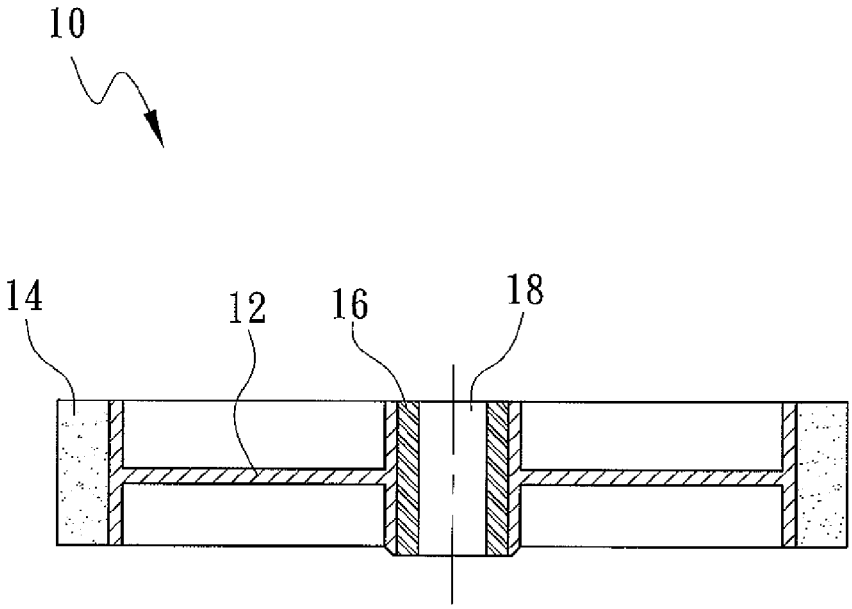
FIG. 2 Prior Art
FIG. 2 is a cross-sectional view of the conventional rotary wheel of FIG I.
Figure 3:
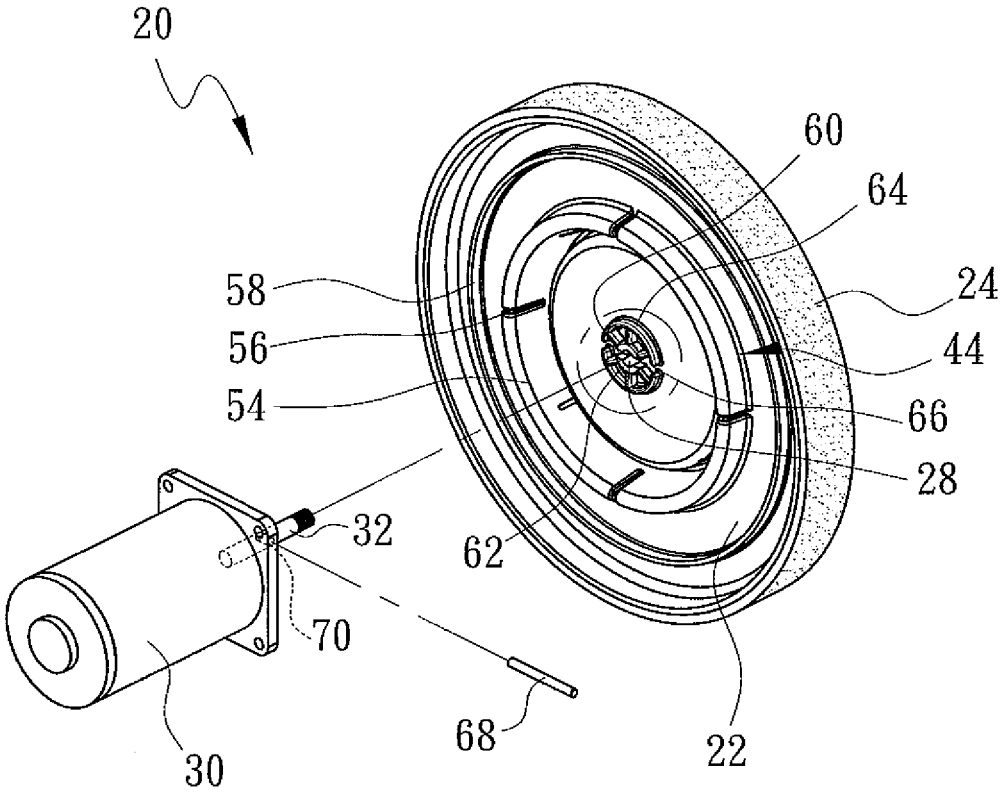
FIG. 3 is a perspective view of a rotary wheel of the present invention and a motor for a ball pitching machine, with an enlarged view of a circled portion of the rotary wheel.
Figure 3:
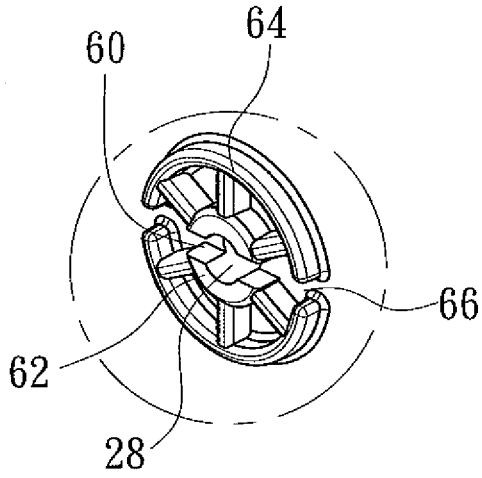
Figure 4:
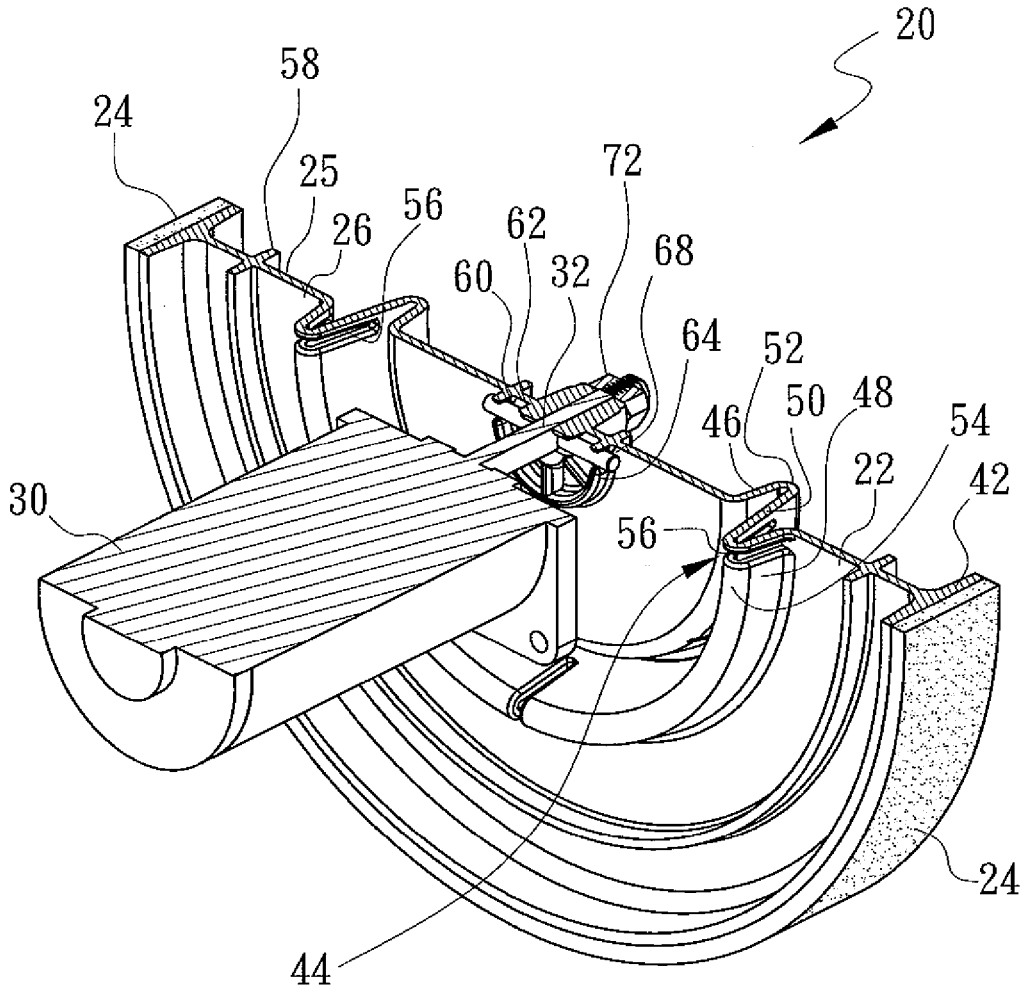
FIG. 4 is a partial, sectioned view of the rotary wheel and the motor of FIG. 3.
Figure 5:
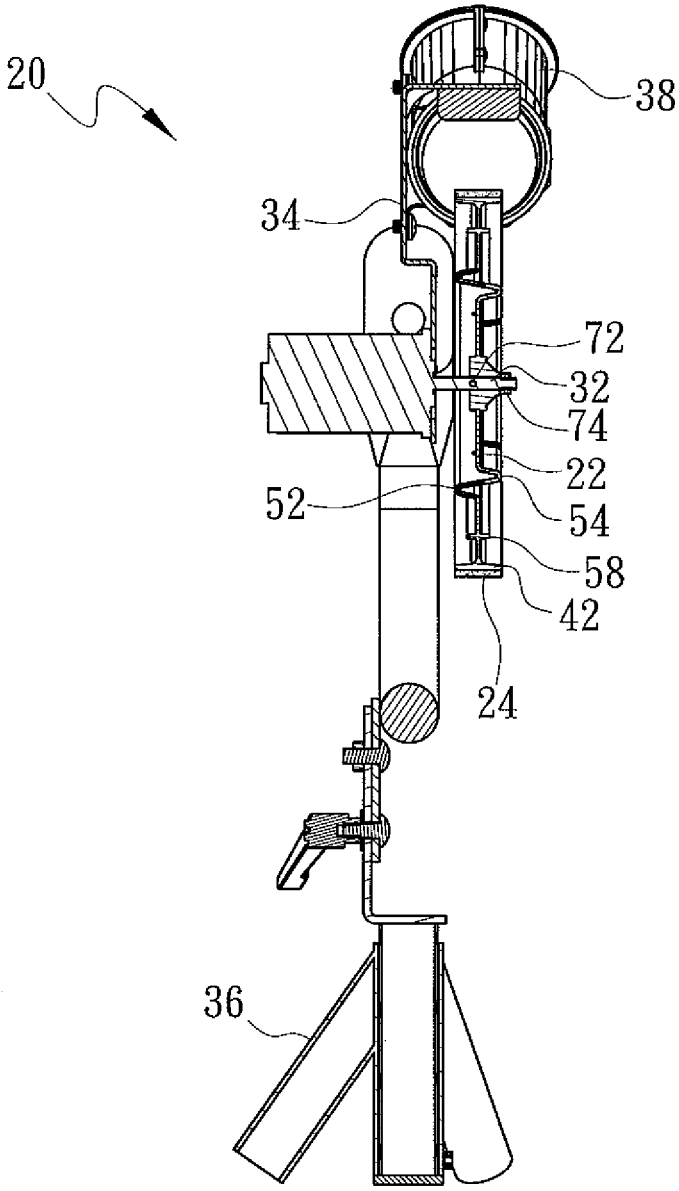
FIG. 5 shows a cross-sectional view of the rotary wheel of FIG. 3 with the rotary wheel assembled in a machine housing of the ball pitching machine.

The rotary wheel 20 of the present invention features the plastic wheel body 22 including an annular spring portion 44 developed between the shaft hole 28 and the outer periphery 42 of the wheel body 22 in a radial direction perpendicular to the axis and having an effect to resist or moderate shocks. The spring portion 44 includes a first annular wall 46 extending outwardly from the first surface 25, a second annular wall 48 extending outwardly from the second surface 26, and a third annular wall 50 interconnected between outer ends of the first and second annular walls 46 and 48, such that the spring portion 44 has a first bending portion 52 protruding outwardly from the first surface 25 and a second bending portion 54 protruding outwardly from the second surface 26. The first and second bending portions 52 and 54 are developed to be a continuous wavelike shape so that the spring portion 44 has an approximate S-shaped cross section, and both the first and second bending portions 52 and 54 can be compressed or stretched in the radial direction. In this embodiment, each of the first and second annular walls 46 and 48 is extended at an obtuse angle relative to the radial direction of the wheel body 22, making each of the first and second bending portions 52 and 54 become an approximate V-shaped cross section (FIG. 4). However, each of the first and second bending portions 52 and 54 is not limited to a V-shaped cross section. Furthermore, a plurality of cutting slots 56 is provided in each of the first and second bending portions 52 and 54 and spaced in a peripheral direction of the spring portion 44. The plurality of cutting slots 56 is used in adjusting resilience of the spring portion 44 and distributing forces applied on the wheel body 22 and the spring portion 44 in order to apply uniform forces on the first and second bending portions 52 and 54. In this embodiment, an annular stiffening rib 58 is formed on each of the first and second surfaces 25 and 26 of the wheel body 22 and located between the outer periphery 42 and the spring portion 44 of the wheel body 22 in the radial direction in order to reinforce strength of the wheel body 22.

Additional characteristic of the rotary wheel 20 of the present invention is a coupling socket 60 formed in the wheel body 22, so that the rotary wheel 20 can be securely engaged with the shaft 32 of the motor 30. In this embodiment, diametrically spaced inner and outer convex ribs 62 and 64 are formed on each of the first and second surfaces 25 and 26 of the wheel body 22 and around the shaft hole 28. Two opposite engaging slots 66 are provided in each of the inner and outer convex ribs 62 and 64 on the second surface 26 of the wheel body 22 and aligned in the radial direction, defining the coupling socket 60 for a pin rod 68 correspondingly inserted and coupled. In this embodiment, a connecting hole 70 is formed in the shaft 32 to allow the pin rod 68 to be inserted through. With the shaft 32 extending through the shaft hole 28 of the wheel body 22 and the pin rod 68 inserted into the coupling socket 60 and the connecting hole 70, a nut 72 can be used to fix and lock a tail end of the shaft 32.

In the implementation of the rotary wheel 20 of the present invention, the spring portion 44 compressed along the radial direction is able to absorb impact energy and, thus, effectively resist shocks without the wheel body 22 broken or damaged when the wheel body 22 suffers from compressive impact. In addition, the rotary wheel 20 has a longer service life in virtue of effects of the coupling socket 60 to maintain the shaft 32 not separated from the wheel body 22 under long-term compression.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A rotary wheel for a ball pitching machine, comprising:

a wheel body including first and second surfaces opposite along an axis and a shaft hole provided in the wheel body and adapted to be extended through by a shaft of a motor of the ball pitching machine, with the rotary wheel further including an annular spring portion formed between the shaft hole and an outer periphery of the wheel body in a radial direction perpendicular to the axis, with the spring portion including a first bending portion protruding outwardly from the first surface and a second bending portion protruding outwardly from the second surface of the wheel body, with each of the first and second bending portions capable of being compressed or stretched in the radial direction, and a resilient member engaged on the outer periphery of the wheel body.

2. The rotary wheel according to claim 1, with the spring portion including a first annular wall extending outwardly from the first surface, a second annular wall extending outwardly from the second surface, and a third annular wall interconnected between outer ends of the first and second annular walls, defining the first and second bending portions, with each of the first and second annular walls extending at an obtuse angle relative to the radial direction of the wheel body, and with each of the first and second bending portions having V-shaped cross sections.

3. The rotary wheel according to claim 2, with the spring portion further including a plurality of cutting slots provided in each of the first and second bending portions and spaced in a peripheral direction of the spring portion for adjusting resilience of the spring portion.

4. The rotary wheel according to claim 3, with the spring portion further including an annular stiffening rib formed on each of the first and second surfaces of the wheel body and located between the outer periphery and the spring portion of the wheel body in the radial direction.

5. The rotary wheel according to claim 3, with the rotary wheel further including spaced inner and outer convex ribs formed on one of the first and second surfaces and around the shaft hole of the wheel body, with two opposite engaging slots provided in each of the inner and outer convex ribs of the wheel body and aligned in the radial direction, defining a coupling socket for a pin rod inserted and coupled, and with the pin rod extending through a connecting hole formed in the shaft of the motor.

6. The rotary wheel according to claim 1, with the first and second bending portions developed to be a continuous wavelike shape and having an S-shaped cross section.

7. The rotary wheel according to claim 6, with the spring portion further including a plurality of cutting slots provided in each of the first and second bending portions and spaced in a peripheral direction of the spring portion for adjusting resilience of the spring portion.

* * * * *